US006683422B1

(12) United States Patent
Moyer

(10) Patent No.: US 6,683,422 B1
(45) Date of Patent: Jan. 27, 2004

(54) FULL WAVE SENSE AMPLIFIER AND DISCHARGE LAMP INVERTER INCORPORATING THE SAME

(75) Inventor: James Copland Moyer, San Jose, CA (US)

(73) Assignee: Monolithic Power Systems, Inc., Los Gatos, CA (US)

( * ) Notice: Subject to any disclaimer, the term of this patent is extended or adjusted under 35 U.S.C. 154(b) by 0 days.

(21) Appl. No.: 10/354,541

(22) Filed: Jan. 29, 2003

(51) Int. Cl.[7] ..... H05B 37/02
(52) U.S. Cl. ..... 315/307; 363/74
(58) Field of Search ..... 315/307, 291; 363/59, 74, 123, 109; 330/277, 250

(56) References Cited

U.S. PATENT DOCUMENTS 4,562,386 A * 12/1985 Goff et al. ..... 318/254
5,914,572 A * 6/1999 Qian et al. ..... 315/307
6,259,615 B1 * 7/2001 Lin ..... 363/98
6,316,881 B1 * 11/2001 Shannon et al. ..... 315/219
2002/0171376 A1 * 11/2002 Rust et al. ..... 315/276

* cited by examiner

*Primary Examiner*—Don Wong
*Assistant Examiner*—Thuy Vinh Tran
(74) *Attorney, Agent, or Firm*—Perkins Coie LLP

(57) ABSTRACT

A full wave sense amplifier for sensing a periodic current flowing through a discharge lamp is disclosed. The full wave sense amplifier comprises a first circuit for sensing the positive going portion of the periodic current. The amplifier also includes a second circuit for sensing the negative going portion of the periodic current. Finally, an output circuit for combining the negative going portion and the positive going portion into a current flow signal is provided.

5 Claims, 4 Drawing Sheets

FULL WAVE SENSE AMPLIFIER AND DISCHARGE LAMP INVERTER INCORPORATING THE SAME

TECHNICAL FIELD

The present invention relates to voltage or current sense amplifiers, and more particularly, to a sense amplifier that can sense the full wave of the alternating current (AC) in a discharge lamp.

BACKGROUND

A discharge lamp, such as a cold cathode fluorescent lamp (CCFL), has terminal voltage characteristics that vary depending upon the immediate history and the frequency of a stimulus (AC signal) applied to the lamp. Until the CCFL is "struck" or ignited, the lamp will not conduct a current with an applied terminal voltage that is less than the strike voltage. Once an electrical arc is struck inside the CCFL, the terminal voltage may fall to a run voltage that is approximately ⅓ of the strike voltage over a relatively wide range of input currents. When the CCFL is driven by an AC signal at a relatively high frequency, the CCFL (once struck) will not extinguish on each cycle and will exhibit a positive resistance terminal characteristic.

Driving a CCFL with a relatively high frequency square-shaped AC signal will produce the maximum useful lifetime for the lamp. However, since the square shape of an AC signal may cause significant interference with other circuits in the vicinity of the circuitry driving the CCFL, the lamp is typically driven with an AC signal that has a less than optimal shape such as a sine-shaped AC signal.

Typically, the lamp is driven by an inverter, which converts a DC signal to an AC signal, filters the AC signal, and transforms the voltage to the higher voltages required by a CCFL. Examples of such inverters are shown in U.S. Pat. No. 6,114,814 to Shannon et al., assigned to the assignee of the present invention and herein incorporated by reference in its entirety. Also, the MPN1011, MP1015, and MP1018 products from Monolithic Power Systems, Inc. are exemplary of the type of inverter-used to drive a CCFL.

In order to most efficiently deliver power to the lamp, it is necessary to monitor the current delivered to the lamp. Therefore, a sense amplifier is used to monitor the lamp current.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION

Figure 1:
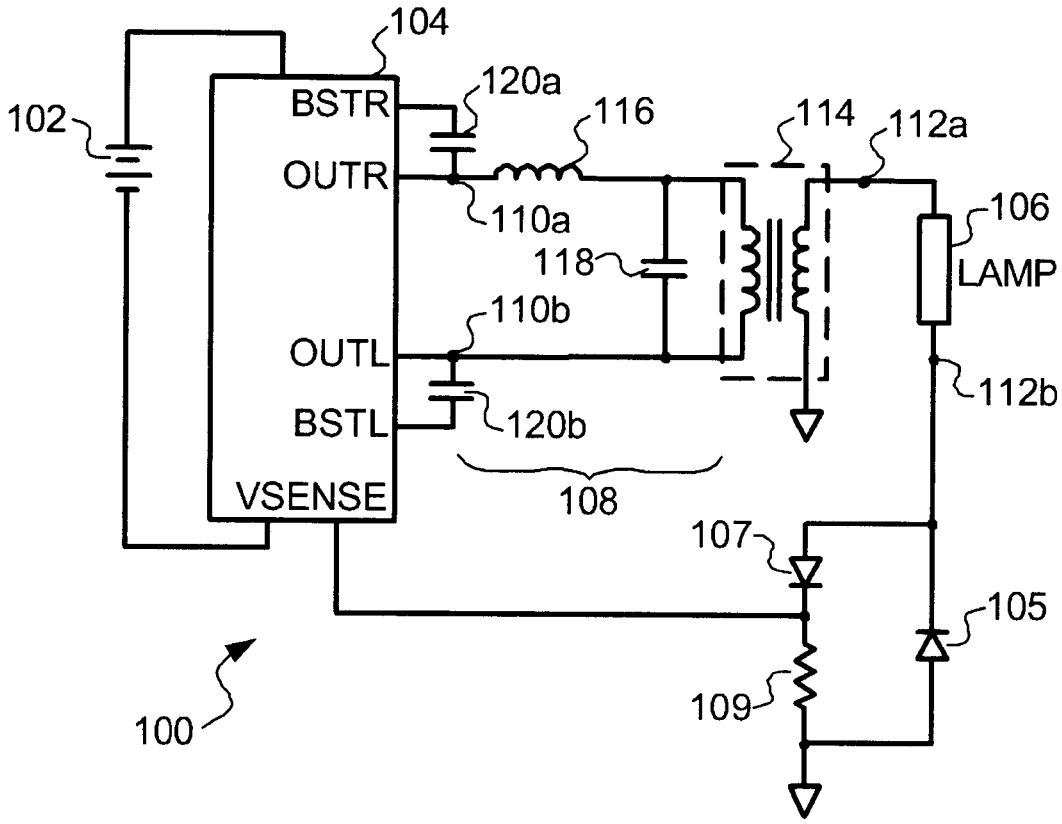
FIGURE 1 (PRIOR ART)
FIG. 1 is an exemplary schematic of a current controlled integrated circuit coupled to another tank circuit on a primary side of the step-up transformer for driving the discharge lamp.

As noted above, inverters for driving a CCFL typically comprise a DC to AC converter, a filter circuit, and a transformer. Examples of such circuits are shown in U.S. Pat. No. 6,114,814 to Shannon et al., assigned to the assignee of the present invention and herein incorporated by reference in its entirety. In addition, other prior art inverter circuits, such as a current-fed push-pull (Royer) oscillator, a constant frequency half-bridge (CFHB) circuit, or an inductive-mode half-bridge (IMIB) circuit, may be used to drive a CCFL. The present invention may be used in conjunction with any of these inverter circuits, as well as other inverter circuits.

The disclosure herein teaches a method and apparatus for monitoring the current drawn by (or delivered to) a lamp. In accordance with the invention, a sense amplifier is used to monitor the full wave of the current, not just the negative going or positive going portions. Prior to proceeding with the description of the sense amplifier, a brief description of the operation of an inverter and lamp combination is provided. It can be appreciated that this is but one embodiment of an inverter, and therefore, the sense amplifier of the present invention may be used with nearly any inverter design using current monitoring.

In one embodiment, the present invention is an integrated circuit (IC) that includes four power MOSFETs arranged in an H-bridge circuit. The IC in combination with a separate output network inverts a direct current (DC) signal into an alternating current (AC). The IC operates near the resonant frequency of the output filter network comprising inductive and capacitive elements.

Losses in the filter network can be minimized by designing for a low loaded Q (to minimize current circulating through the tank components and the switches) and a high unloaded Q (which means the inductors and capacitors have low loss). Nevertheless, the harmonic content of the output waveform should be maintained at a low level to ensure that the inverter does not interfere with the operation of nearby circuits.

In one typical circuit, the H-bridge circuit generates an AC signal by periodically inverting a DC signal. The control circuitry regulates the amount of electrical power delivered to the load by modulating the pulse width (PWM) of each half cycle of the AC signal. Since the PWM provides for a symmetrical AC signal during normal operation, even harmonic frequencies in the AC signal are canceled out. By eliminating the even harmonics and generally operating at the resonant frequency of the filter (load), the designed loaded Q value of the filter may be fairly low and losses in the filter may be minimized. Also, since the CCFL is connected directly across the secondary winding of the step-up transformer, except for the fraction of a second required to strike an arc inside the lamp, the step-up transformers secondary winding generally operates at the run voltage of the CCFL. Further, it will be seen further below that the control circuitry will selectively increase the width of the pulses provided to the load during striking of the load, relative to normal operation.

Turning now to FIG. 1, an exemplary schematic 100' displays the power control embodiment of an integrated circuit 104 (IC) coupled to a load that includes a tank circuit 108 and a lamp 106 such as a CCFL. A DC power supply 102, i.e., a battery, is connected to IC 104. A boost capacitor 120*a* is connected between a BSTR terminal and an output terminal 110*a*, which is connected to another terminal labeled as OUTR. Similarly, another boost capacitor 120*b* is connected between a BSTL terminal and an output terminal 110*b* that is connected to another terminal identified as OUTL. The boost capacitors 120*a* and 120*b* are energy reservoirs that provide a source of power to operate circuitry inside the IC 104 that can float above the operating voltage of the rest of the circuitry.

An end of inductor 116 is connected to the output terminal 110*a* and an opposite end of the inductor is coupled to an end of a capacitor 118 and an end of a primary winding of a step-up transformer 114. An opposite end of the capacitor 118 is coupled to another end of the primary winding of the step-up transformer 114 and the output terminal 110*b*. An end of a secondary winding for the step-up transformer 114 is connected to a lamp terminal 112*a* and another end of the secondary winding is connected to a lamp terminal 112*b*.

A reactive output network or the "tank" circuit 108 is formed by the components connected between the output terminals 110*a* and 110*b* and the primary winding of the step-up transformer 114. The tank circuit is a second-order resonant filter that stores electrical energy at a particular frequency and discharges this energy as necessary to smooth the sinusoidal shape of the AC signal delivered to the lamp 106. The tank circuit is also referred to as a self-oscillating circuit.

Further, a circuit for current sensing is included. Note that the second terminal of the secondary winding is directly connected to ground. The other lamp terminal 112*b* is coupled to an anode of a diode 107 and a cathode of a diode 105. The cathode of the diode 107 is coupled to an end of a sense resistor 109 and a $V_{sense}$ terminal at the IC 104. The anode of the diode 105 is coupled to the other end the sense resistor 109 and ground. In this case, the IC 104 monitors the voltage across the sense resistor 109 so that the amount of current flowing into the lamp 106 may be approximated and used to control the amount of electrical power used to drive the lamp.

Figure 2A:
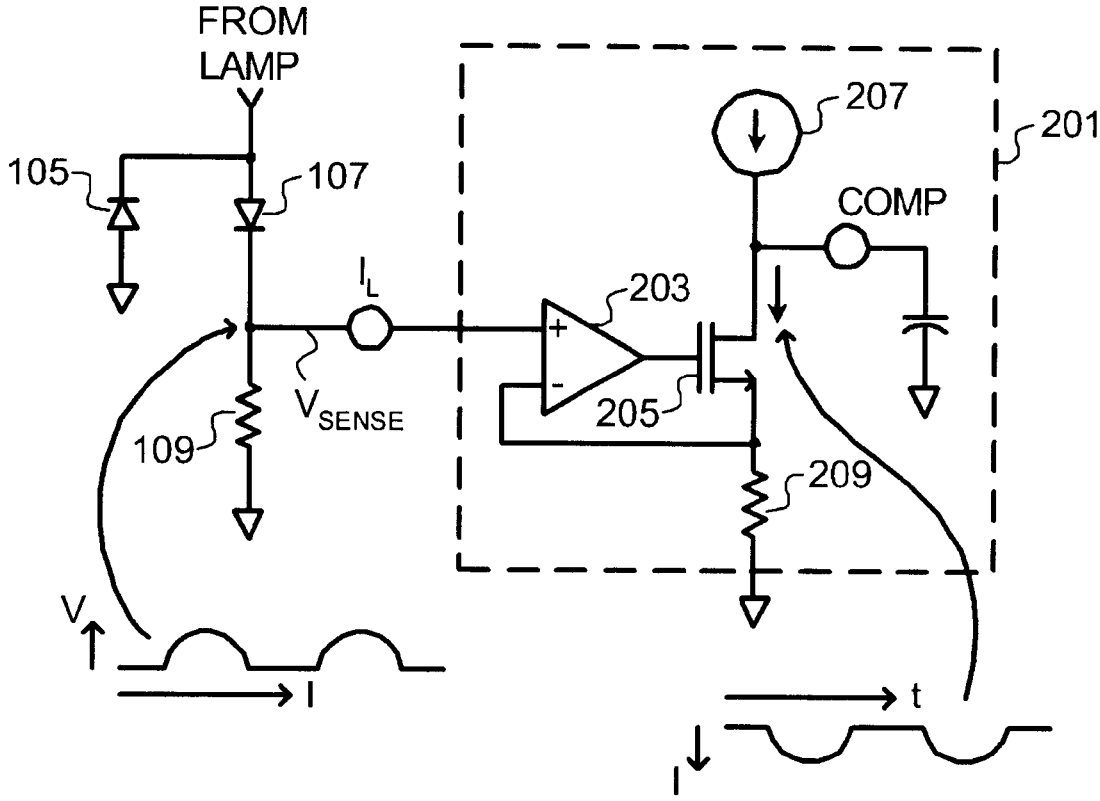
FIGURE 2A (PRIOR ART)
FIGS. 2A and 2B are schematic diagrams of prior art half-wave sense amplifiers.

The signal carried on the $V_{sense}$ terminal is provided to a half-wave sense amplifier 201. In one prior art embodiment, the sense amplifier is shown in FIG. 2A. The half-wave sense amplifier 201 comprises an operational amplifier 203, an output transistor 205, a current source 207, and a resistor 209. Because of the arrangement of the diodes 105 and 107, the current $I_L$, and thus the voltage V across the sense resistor 109, only captures the positive going half of the current through the lamp. It should be noted that sensing of the current and sensing of the voltage is synonymous. In other words, it can be appreciated that sensing the voltage across the sense resistor 109 is the same as sensing the current drawn by the lamp.

In operation, current flowing out of the diode 107 will travel through the sense resistor 109, causing a voltage to be placed on the non-inverting input of the operational amplifier 203. The output of the operational amplifier is provided to the gate of the output transistor 205. The drain of the output transistor 205 is connected to the inverting input of the operational amplifier 203 and one terminal of the resistor 209. The other terminal of the resistor 209 is connected to ground.

The source of the output transistor is connected to current source 207. The amount of current drawn from the current source 207 is thus indicative of the current drawn by the lamp. Note that the current drawn from the current source 207 is the inverse of the current drawn by the lamp because of the inverting action of the operational amplifier 203.

Figure 2B:
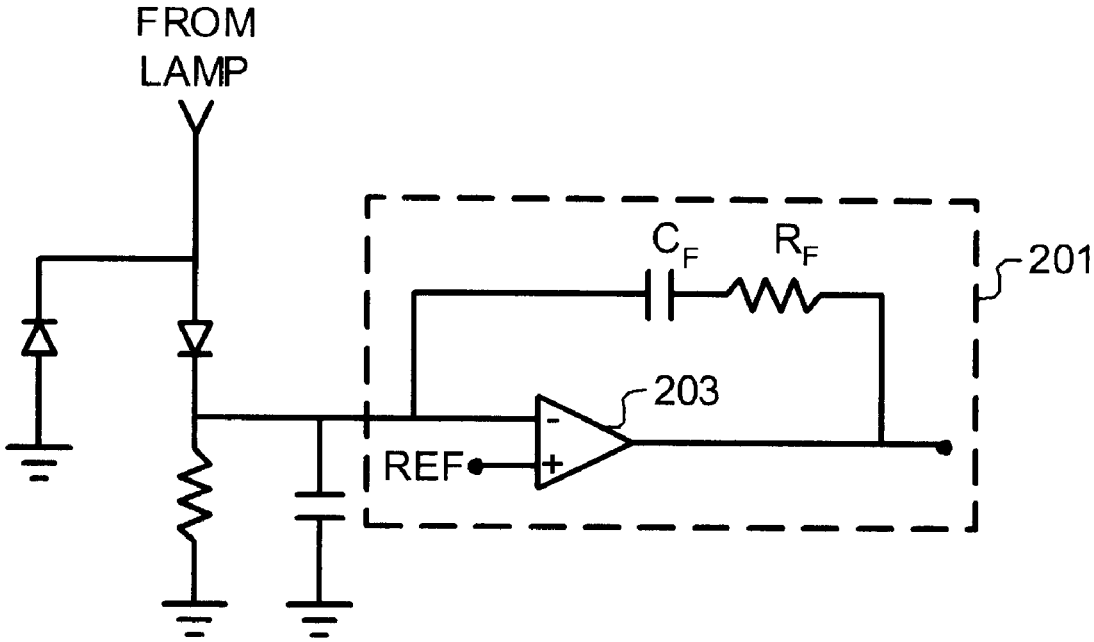
FIGURE 2B (PRIOR ART)

FIG. 2B shows another embodiment of a prior art sense amplifier 201. In this arrangement, the summing node is at the inverting input to the operational amplifier 203. A feedback capacitor $C_f$ and feedback resistor $R_f$ are placed between the output of the operational amplifier 203 and the inverting input. Again, this arrangement still only looks at half of the current being provided to the lamp.

Figure 3:
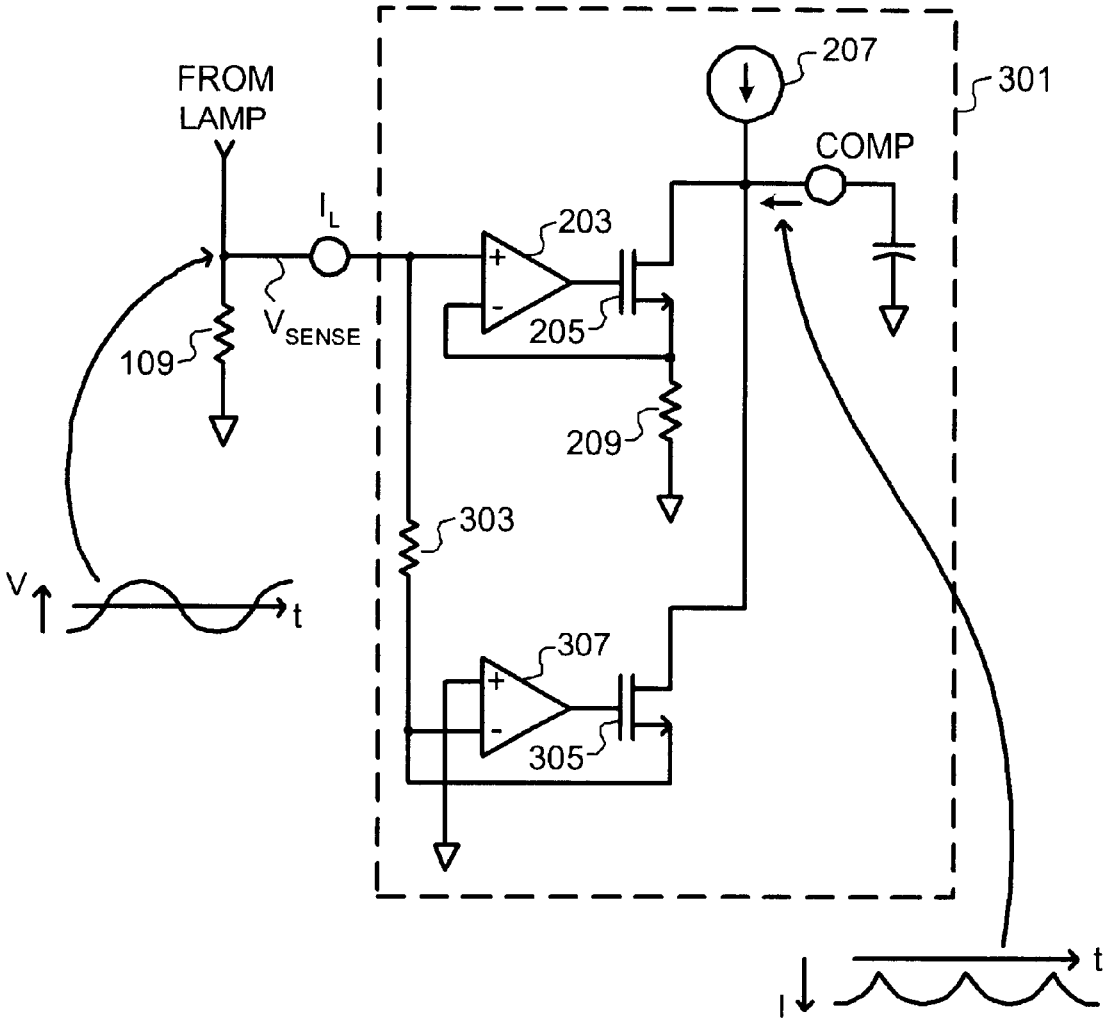
FIG. 3 is a schematic diagram of a full-wave sense amplifier formed in accordance with the present invention.

In accordance with the present invention, turning to FIG. 3, a full wave sense amplifier 301 is shown. Note initially, that the full wave sense amplifier 301 is intended for use without the diodes 105 and 107 of FIGS. 1B and 2. Thus, these elements are removed and the signal $V_{sense}$ is taken directly from node 112*b* of FIG. 1.

The full wave sense amplifier 301 includes the operational amplifier 203, the output transistor 205, resistor 209, and current source 207 of the prior art half wave amplifier 201. Additionally, the full wave sense amplifier 301 also includes a second operational amplifier 307, a second output transistor 305, and an input resistor 303.

The signal $V_{sense}$ is provided through input resistor 303 to the inverting input of the second operational amplifier. The non-inverting input of the second operational amplifier 307 is grounded. The output of the second operational amplifier is connected to the gate of the second output transistor 305. The drain of the second output transistor 305 is connected to the inverting input of the second operational amplifier 307. The source of the second output transistor 305 is connected to current source 207.

As noted above, the diodes 105 and 107 are eliminated. This results in the signal $V_{sense}$ following the current drawn by the lamp. It can be appreciated that the current drawn by the lamp across the resistor 109 is the voltage signal $V_{sense}$. The positive going half of the signal $V_{sense}$ is captured by the operational amplifier 203 and first output resistor 205. The negative going half of the signal $V_{sense}$ is captured by the second operational amplifier 307 and second output transistor 305. The result of this arrangement is the full wave of the signal $V_{sense}$ is captured by the current drawn from current source 207, as seen in FIG. 3.

There are some advantages to sensing the full sinusoidal wave of the lamp current. Sensing both half-cycles effectively doubles the sampling rate of the loop and allows for a faster loop time constant and therefore tighter control of the loop.

While the preferred embodiment of the invention has been illustrated and described, it will be appreciated that various changes can be made therein without departing from the spirit and scope of the invention.

I claim:

1. A full wave sense amplifier for sensing a periodic current flowing through a lamp, the full wave sense amplifier comprising:

means for sensing a positive going portion of said periodic current;

means for sensing a negative going portion of said periodic current; and means for combining said negative going portion and said positive going portion into a current flow signal;

wherein said means for sensing the positive going portion comprises:

an first operational amplifier having a first input connected to a terminal of said lamp, and an first output transistor having its gate connected to an output of said operational amplifier, its source connected to a current source, and its drain connected to a second input of said operational amplifier.

2. The amplifier of claim 1 wherein said means for sensing the negative going portion comprises:

a second operational amplifier having a second input connected to a terminal of said lamp; and a second output transistor having its gate connected to an output of said operational amplifier, its source connected to a current source, and its drain connected to said second input of said operational amplifier.

3. The amplifier of claim 2 wherein the first input of said first operational amplifier is grounded.

4. The amplifier of claim 2, wherein said second input of said second operational amplifier is connected to said terminal of said lamp through a resistor.

5. The amplifier of claim 1 wherein said means for combining is a current source supplying current flowing through said first output transistor and said second output transistor.

* * * * *

UNITED STATES PATENT AND TRADEMARK OFFICE

CERTIFICATE OF CORRECTION

PATENT NO. : 6,683,422 B1
DATED : January 27, 2004
INVENTOR(S) : James Copland Moyer It is certified that error appears in the above-identified patent and that said Letters Patent is hereby corrected as shown below:

Column 1,
Line 39, "MPN1011" should be -- MP1011 --;

Column 2,
Line 4, "(IMIB)" should be -- (IMHB) --;

Column 4,
Lines 44, and 46, "an first" should be -- a first --;

Signed and Sealed this

Twenty-second Day of June, 2004

JON W. DUDAS
*Acting Director of the United States Patent and Trademark Office*